US011944147B1

(12) United States Patent
Rausch

(10) Patent No.: US 11,944,147 B1
(45) Date of Patent: Apr. 2, 2024

(54) DETACHABLE CAP LIGHTS

(71) Applicant: Barry Rausch, Maple Grove, MN (US)

(72) Inventor: Barry Rausch, Maple Grove, MN (US)

( * ) Notice: Subject to any disclaimer, the term of this patent is extended or adjusted under 35 U.S.C. 154(b) by 0 days.

(21) Appl. No.: 18/376,166

(22) Filed: Oct. 3, 2023

(51) Int. Cl.
*A42B 1/242* (2021.01)

(52) U.S. Cl.
CPC ..... *A42B 1/242* (2013.01)

(58) Field of Classification Search
CPC ..... A42B 1/242
See application file for complete search history.

(56) References Cited

U.S. PATENT DOCUMENTS 5,276,985 A 1/1994 Halloran
5,282,278 A * 2/1994 Miner ..... A42B 1/248 40/329
5,740,557 A * 4/1998 Reid ..... A42B 1/248 2/244
6,163,889 A * 12/2000 Tate ..... A63B 57/353 2/209.13
6,175,963 B1 1/2001 Loeffeholz
2009/0119819 A1* 5/2009 Thompson ..... A42B 1/0182 2/209.13

* cited by examiner

*Primary Examiner* — Thomas M Sember
(74) *Attorney, Agent, or Firm* — Sanchelima & Associates, P.A.; Christian Sanchelima; Jesus Sanchelima

(57) ABSTRACT

Detachable cap lights including a cap assembly, an attaching assembly and a light assembly. The cap assembly includes a cap. The attaching assembly includes an attaching band. The light assembly includes a housing and lights. The attaching band is attached to a rear side of the cap. The attaching band includes a magnet on an exterior wall of the attaching band. The lights are embedded within the housing. The housing has a magnetic layer. The housing is attached to the magnet of the attaching band through the magnetic layer.

10 Claims, 2 Drawing Sheets

DETACHABLE CAP LIGHTS

BACKGROUND OF THE INVENTION

1. Field of the Invention

The present invention relates to detachable cap lights and, more particularly, to detachable cap lights, that allows forming different lighted shapes and lighted words in the back of a cap by means of detachable lights.

2. Description of the Related Art

Several designs for detachable lights have been designed in the past. None of them, however, include a band formed in a back portion of the cap capable of receiving detachable lights.

Applicant believes that a related reference corresponds to U.S. Pat. No. 6,175,963 issued for an attire having magnetically affixed emblems. Applicant believes that another related reference corresponds to U.S. Pat. No. 5,276,985 issued for a detachable cap plaque. None of these references, however, teach of a cap having interchangeable illuminated letters and symbols that may be repositioned in a variety of orientations on the cap. The interchangeable illuminated letters and symbols may be secured to the cap using various fasteners including magnets or other suitable fastening means.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide detachable cap lights that includes an attaching member capable of receiving detachable lights therein.

It is another object of this invention to provide detachable cap lights that include portable lights which include rechargeable batteries and can be selectively powered.

It is still another object of the present invention to provide detachable cap lights that includes detachable lights having a thickness and size suitable for being portable and easily carried.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
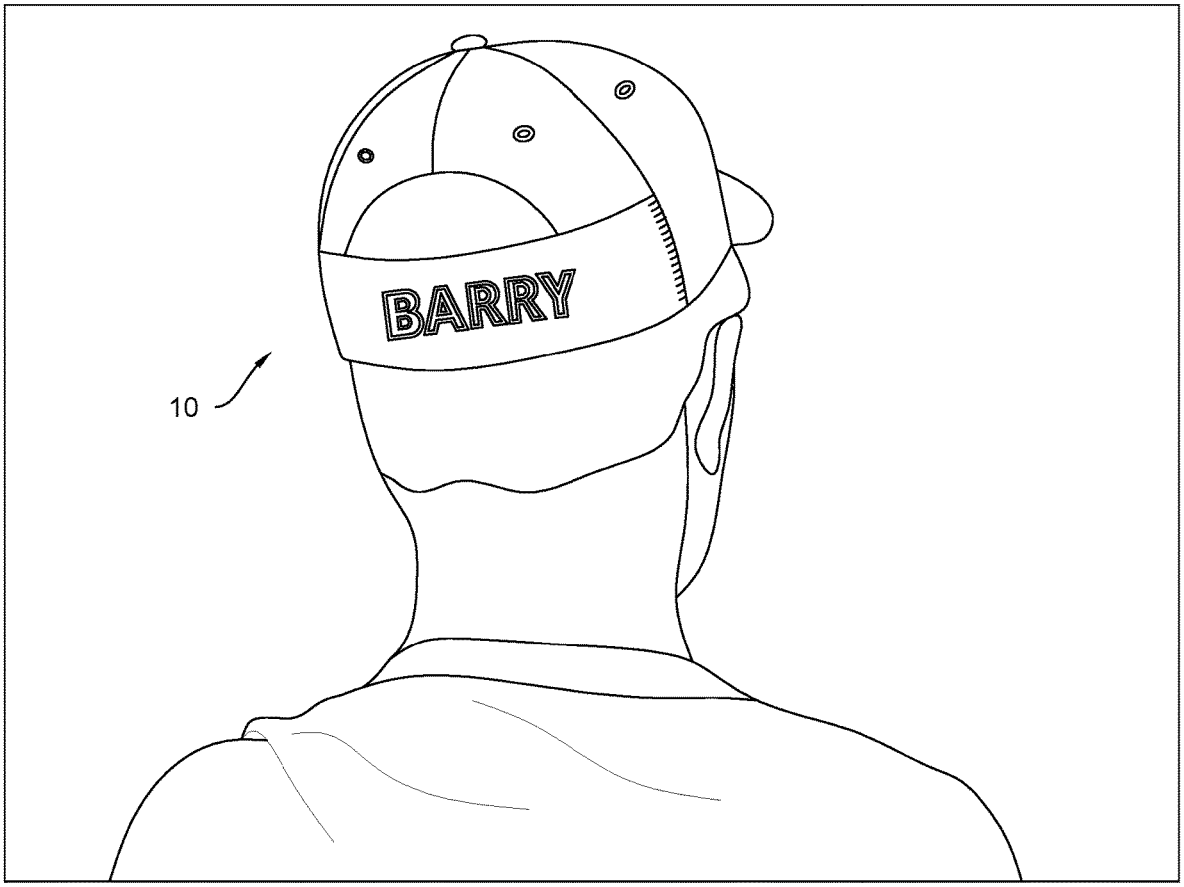
FIG. 1 represents an isometric operational view of the present invention 10.

Referring now to the drawings, where the present invention is generally referred to with numeral 10, it can be observed that it basically includes a cap assembly 20, an attaching assembly 40 and a light assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The cap assembly 20 may include a cap 21. Cap 21 may be made of cotton, wool, or any other suitable material. The cap 21 may substantially have an hemispherical shape. The cap 21 may have a visor 23 attached to a front portion thereof. The cap 21 may have the attaching assembly 40 sewn in a rear portion thereof. The cap 21 may be a baseball cap, a trucker cap, or any other suitable cap.

The attaching assembly 40 may include an attaching band 42. The attaching band 42 may be sewn to the rear portion of the cap 21 by means of sewing 22. The attaching band 42 may be a magnet. In a preferred embodiment the attaching band 42 may be made of plastic covered by a magnetic film. The attaching band 42 may have a greater height than a length thereof. In a preferred embodiment the attaching band 42 may have an elongated rectangular shape. The attaching band 42 may be suitable for receiving metallic members therein.

Figure 2:
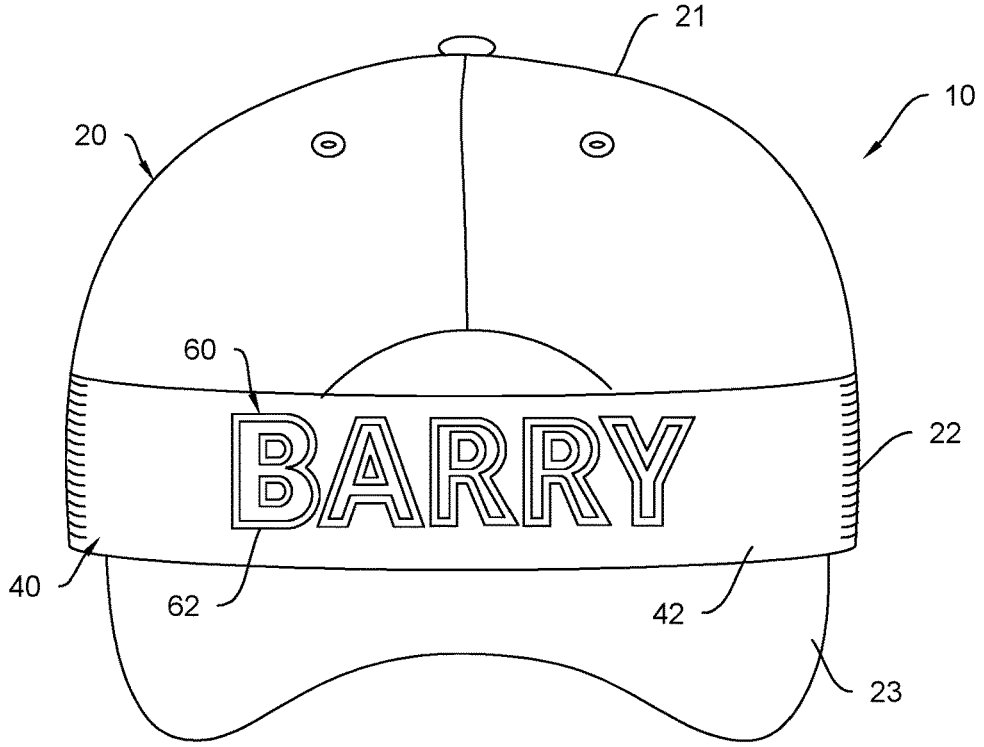
FIG. 2 shows a rear perspective view of the present invention 10, the present invention 10 including a cap assembly 20, an attaching assembly 40 and a light assembly 60.
Figure 3:
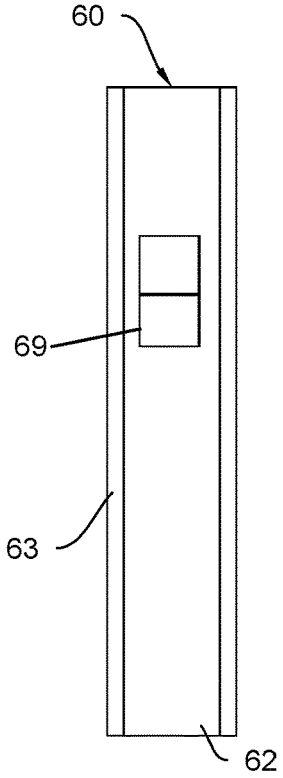
FIG. 3 depicts a side enlarged view of the light assembly 60.
Figure 4:
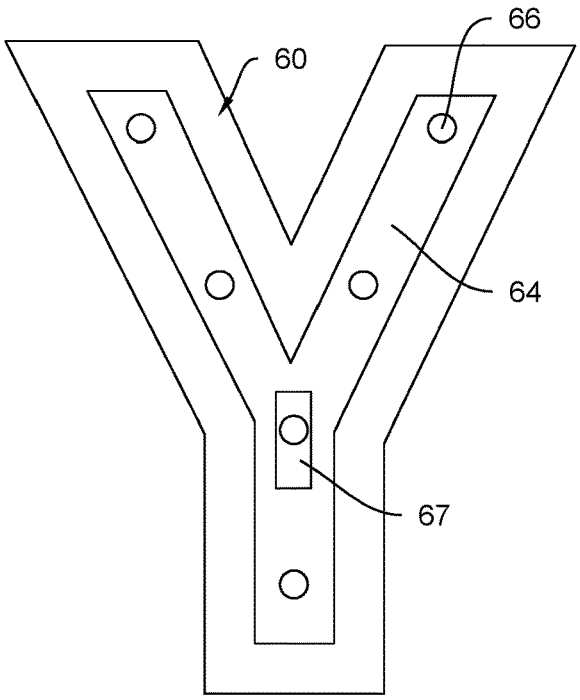
FIG. 4 illustrates a see-through front view of the light assembly 60.

Referring now to FIG. 3 and FIG. 4 it can be observed that the light assembly 60 may include a housing 62, lights 66, a bottom layer 63, a button 69, and a battery 67. In a preferred embodiment the housing 62 may be made of polyurethane. It also may be suitable for the housing 62 to be made of polyvinyl chloride, steel, or any other suitable material. The housing 62 may have a top wall, side walls and a bottom wall. The top wall of the housing 62 may be made of a transparent plastic. The housing 62 may be hollow, defining an inner cavity 64. Inner cavity 64 conforming to the shape of the housing 62. The housing 62 may be shaped as a letter, an animal, a figurine and so on. Best shown in FIG. 2, the housing 62 may take the shape of letters "B", "A", "R" and "Y" but any shape may be suitable. The housing 62 may be flexible.

The lights 66 may be embedded within the cavity 64. In a preferred embodiment the lights 66 may be light emitting diodes. The lights 66 may be interconnected therebetween. The lights 66 may be powered by means of the battery 67. Battery 67 may be a rechargeable battery. The button 69 may be embedded in a side wall of the housing 62. The button 69 may be depressed to turn on the lights 66. In some embodiments the lights 66 may blink in patterns illuminating the housing 62. Blinking patterns may be activated through button 69.

The bottom wall of the housing 62 may have the bottom layer 63 covering the bottom wall. In a preferred embodiment the bottom layer 63 may be a magnet. It also may be suitable for the bottom layer 63 to be made of a metallic material. The bottom layer 63 may be coupled with the attaching band 42 by means of the bottom layer 63.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. Detachable cap lights, comprising:

a cap assembly, wherein said cap assembly includes a cap;

an attaching assembly, wherein said attaching assembly includes an attaching band, said attaching band attached to a rear side of the cap, wherein said attaching band includes a magnet on an exterior wall of the attaching band; and a light assembly, wherein said light assembly includes a housing and lights, said lights embedded within the housing, the housing has a magnetic layer, said housing attached to the magnet of the attaching band by means of said magnetic layer.

2. The detachable cap lights set forth in claim 1, wherein said attaching band has a rectangular elongated shape.

3. The detachable cap lights set forth in claim 1, wherein said attaching band is sewn to the rear side of said cap.

4. The detachable cap lights set forth in claim 1, wherein said lights are light emitting diodes.

5. The detachable cap lights set forth in claim 1, wherein said housing has a shape of a letter of latin alphabet.

6. The detachable cap lights set forth in claim 1, wherein said lights are powered by means of a rechargeable battery, said lights and said rechargeable battery are embedded within said housing.

7. The detachable cap lights set forth in claim 1, wherein said housing includes a button to turn on and turn off said lights, said button is attached to one side of said housing.

8. The detachable cap lights set forth in claim 1, wherein said magnetic layer covers a bottom wall of the housing.

9. Detachable cap lights, comprising:

a cap assembly, wherein said cap assembly includes a cap;

an attaching assembly, wherein said attaching assembly includes an attaching band, said attaching band attached to a rear side of the cap, wherein said attaching band includes a magnet on an exterior wall of the attaching band, wherein said attaching band has a rectangular elongated shape; and a light assembly, wherein said light assembly includes a housing and lights, said lights embedded within the housing, the housing has a magnetic layer, said housing attached to the magnet of the attaching band by means of said magnetic layer, wherein said lights are powered by means of a rechargeable battery, said lights and said rechargeable battery are embedded within said housing.

10. Detachable cap lights, consisting of:

a cap assembly, wherein said cap assembly includes a cap;

an attaching assembly, wherein said attaching assembly includes an attaching band, said attaching band attached to a rear side of the cap, wherein said attaching band is sewn to the rear side of said cap, wherein said attaching band includes a magnet on an exterior wall of the attaching band, wherein said attaching band has a rectangular elongated shape; and a light assembly, wherein said light assembly includes a housing and lights, wherein said lights are light emitting diodes, wherein said housing conforms with the shape of a letter of latin alphabet, said lights embedded within the housing, the housing has a magnetic layer, said housing attached to the magnet of the attaching band by means of said magnetic layer, said magnetic layer covers a bottom wall of the housing, wherein said lights are powered by means of a rechargeable battery, said lights and said rechargeable battery are embedded within said housing, wherein said housing includes a button to turn on and turn off said lights, said button is attached to one side of said housing.

* * * * *